US010738948B2

(12) United States Patent
Li et al.

(10) Patent No.: US 10,738,948 B2
(45) Date of Patent: Aug. 11, 2020

(54) ADAPTER AND ILLUMINATING DEVICE

(71) Applicant: OPPLE LIGHTING CO., LTD., Shanghai (CN)

(72) Inventors: Xianglan Li, Shanghai (CN); Zeyu Liu, Shanghai (CN); Hongbo Wang, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 0 days.

(21) Appl. No.: 16/209,779

(22) Filed: Dec. 4, 2018

(65) Prior Publication Data

US 2019/0107257 A1 Apr. 11, 2019

Related U.S. Application Data

(63) Continuation of application No. PCT/CN2017/084366, filed on May 15, 2017.

(30) Foreign Application Priority Data

Jun. 6, 2016 (CN) ..... 2016 1 0394810
Jun. 6, 2016 (CN) ..... 2016 2 0541859 U

(51) Int. Cl.
*F21K 9/272* (2016.01)
*F21K 9/275* (2016.01)
(Continued)

(52) U.S. Cl.
CPC ..... *F21K 9/272* (2016.08); *F21K 9/275* (2016.08); *F21S 2/00* (2013.01); *F21S 2/005* (2013.01);
(Continued)

(58) Field of Classification Search
CPC .... F21K 9/275; F21K 9/27; F21S 2/00; F21S 2/005; F21Y 101/02; F21V 17/007
See application file for complete search history.

(56) References Cited

U.S. PATENT DOCUMENTS 6,607,284 B1 * 8/2003 Tsai ..... F21V 21/30 362/121
2009/0225546 A1 * 9/2009 Pearson ..... F21S 2/005 362/249.06
(Continued)

FOREIGN PATENT DOCUMENTS

CN 101255960 9/2008
CN 203797439 U 8/2014
(Continued)

OTHER PUBLICATIONS

International Search Report (including English translation) and Written Opinion issued in PCT/CN2017/084366 and dated Aug. 9, 2017, 10 pages.

*Primary Examiner* — Bryon T Gyllstrom
*Assistant Examiner* — Eric T Eide
(74) *Attorney, Agent, or Firm* — Arch & Lake LLP

(57) ABSTRACT

The present disclosure discloses an adapter for the adapting of at least two linear lamps in an illuminating device. The adapter includes: a first adapting member including a first insulating housing, a first light-transmissive hood assembled on the first insulating housing, a first light source component disposed between the first insulating housing and the first light-transmissive hood, and a first connector extended out of the first insulating housing; a second adapting member including a second insulating housing, a second light-transmissive hood assembled on the second insulating housing, a second light source component disposed between the second insulating housing and the second light-transmissive hood, and a second connector extended out of the second insulating housing; and a driving power supply module capable of being disposed in the first or second adapting member and electrically connected with the first and second light source components.

20 Claims, 16 Drawing Sheets

(51) Int. Cl.

| | |
|---|---|
| ***F21V 17/16*** | (2006.01) |
| ***F21S 4/00*** | (2016.01) |
| ***F21S 2/00*** | (2016.01) |
| ***F21V 15/015*** | (2006.01) |
| ***F21V 17/00*** | (2006.01) |
| ***F21Y 103/20*** | (2016.01) |
| ***F21Y 103/10*** | (2016.01) |

(52) U.S. Cl.
CPC ..... *F21S 4/00* (2013.01); *F21V 15/015* (2013.01); *F21V 17/007* (2013.01); *F21V 17/16* (2013.01); *F21Y 2103/10* (2016.08); *F21Y 2103/20* (2016.08)

(56) References Cited

U.S. PATENT DOCUMENTS

2013/0272000 A1* 10/2013 Pearson ..... F21S 2/005 362/362
2013/0279179 A1* 10/2013 Pearson ..... F21S 2/005 362/364
2014/0071668 A1* 3/2014 Ai ..... F21S 2/00 362/219
2014/0307438 A1* 10/2014 Pearson ..... F21S 2/005 362/249.03
2015/0345755 A1 12/2015 Purdy
2016/0298832 A1* 10/2016 Pearson ..... F21V 23/002
2017/0030561 A1* 2/2017 Dix ..... F21S 2/005

FOREIGN PATENT DOCUMENTS

| | | |
|---|---|---|
| CN | 204806213 U | 11/2015 |
| CN | 105889782 | 8/2016 |
| CN | 205678464 U | 11/2016 |
| JP | 2014089817 | 5/2014 |

* cited by examiner

ADAPTER AND ILLUMINATING DEVICE

CROSS-REFERENCE TO RELATED APPLICATION

This application is based upon and claims the priority of PCT patent application No. PCT/CN2017/084366 filed on May 15, 2017 which claims the priority of Chinese Patent Application No. 201610394810.9 filed on Jun. 6, 2016 and Chinese Patent Application No. 201620541859.8 filed on Jun. 6, 2016, the entire content of all of which is hereby incorporated by reference herein for all purposes.

TECHNICAL FIELD

The present disclosure relates to the technical field of illumination, in particular to an adapter for the adapting of linear lamps in an illuminating device, and an illuminating device and a method of manufacturing the adapter.

BACKGROUND

The conventional illuminating devices, e.g., light-emitting diode (LED) lamps, are more and more popular due to the advantages of energy saving, environmental protection and long service life, and may be applied in office, home and other occasions. In order to widen the indoor lighting area, or to meet the needs of indoor lighting in different locations, or to meet the interior decoration effect, an LED lamp may include a plurality of LED linear lamps and a plurality of adapters for connecting two adjacent LED linear lamps in the plurality of LED linear lamps. The linear lamp adapter sometimes is usually made from opaque plastics. When two LED linear lamps are connected, an adapter is required to connect them. Although the overall lighting area of the LED lamp is enlarged, due to the arrangement of the adapters, dark areas will be produced between the LED linear lamps, so continuous linear lighting cannot be realized, and meanwhile, the aesthetic property and the decorative effect of the lamp may also be affected.

SUMMARY

The present disclosure provides an adapter, an illuminating device and a method of manufacturing an adapter.

The present disclosure discloses an adapter for the adapting of at least two linear lamps in an illuminating device. The adapter may include a first adapting member including a first insulating housing, a first light-transmissive hood assembled on the first insulating housing, a first light source component disposed between the first insulating housing and the first light-transmissive hood, and a first connector extended out of the first insulating housing; a second adapting member including a second insulating housing, a second light-transmissive hood assembled on the second insulating housing, a second light source component disposed between the second insulating housing and the second light-transmissive hood, and a second connector extended out of the second insulating housing; and a driving power supply module capable of being disposed in the first or second adapting member and electrically connected with the first and second light source components.

The present disclosure discloses an illuminating device that may include a plurality of linear lamps and an adapter for the adapting of the plurality of linear lamps in the illuminating device. The plurality of linear lamps may be connected by the adapter, and the adapter may include a first adapting member including a first insulating housing, a first light-transmissive hood assembled on the first insulating housing, a first light source component disposed between the first insulating housing and the first light-transmissive hood, and a first connector extended out of the first insulating housing; a second adapting member including a second insulating housing, a second light-transmissive hood assembled on the second insulating housing, a second light source component disposed between the second insulating housing and the second light-transmissive hood, and a second connector extended out of the second insulating housing; and a driving power supply module capable of being disposed in the first or second adapting member and electrically connected with the first and second light source components.

The present disclosure discloses a method of manufacturing an adapter for the adapting of at least two linear lamps in an illuminating device. The method may include obtaining a first adapting member where the first adapting member includes a first insulating housing, a first light-transmissive hood assembled on the first insulating housing, a first light source component disposed between the first insulating housing and the first light-transmissive hood, and a first connector extended out of the first insulating housing; obtaining a second adapting member where the second adapting member includes a second insulating housing, a second light-transmissive hood assembled on the second insulating housing, a second light source component disposed between the second insulating housing and the second light-transmissive hood, and a second connector extended out of the second insulating housing; and obtaining a driving power supply module that is capable of being disposed in the first or second adapting member and is electrically connected with the first and second light source components.

It is to be understood that, both the foregoing general description and the following detailed description are exemplary and explanatory only and are not restrictive of the present disclosure.

BRIEF DESCRIPTION OF THE DRAWINGS

The accompanying drawings described here are provided for the further understanding of the present disclosure and constitute a part of the present disclosure. The examples of the present disclosure and the description thereof are for the purpose of explaining the present disclosure and do not constitute an improper limitation of the present disclosure, in which.

DETAILED DESCRIPTION

For more clear understanding of the objective, the technical proposals and the advantages of the present disclosure, technical proposals of the examples will be described in a clearly and fully understandable way in connection with the drawings related to the examples of the disclosure. It is apparent that the described examples are just a part but not all of the examples of the disclosure. Based on the described examples herein, one of ordinary skill in the art can obtain other example(s), without any creative work, which shall be within the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," etc. may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

As shown in FIGS. 1 to 11, the first example of the present disclosure provides an adapter 100, which is used for the adapting of at least two linear lamps in an illuminating device.

Figure 12:
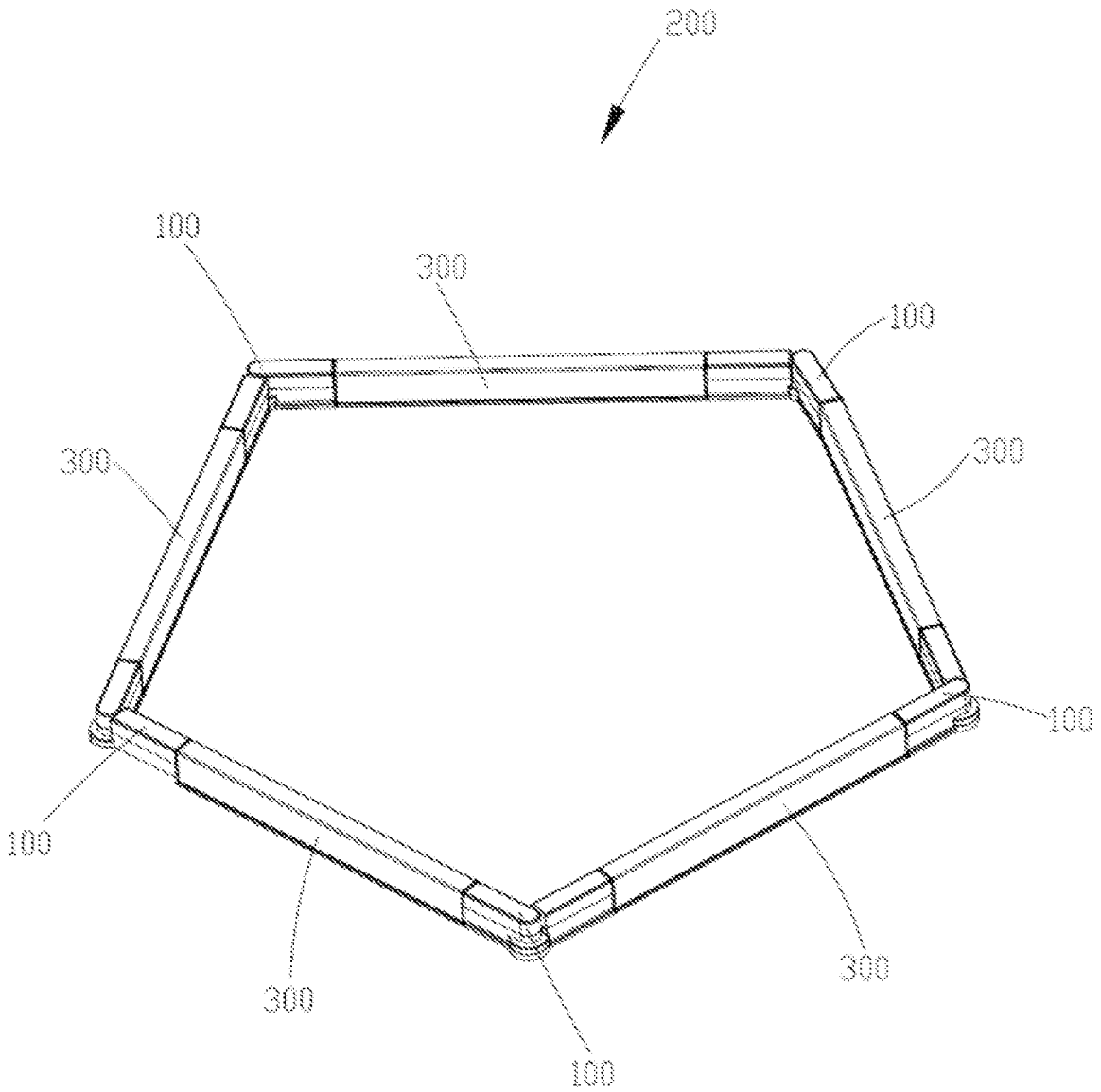
FIG. 12 is a perspective assembly diagram of an illuminating device provided by the second example of the present disclosure.
Figure 13:
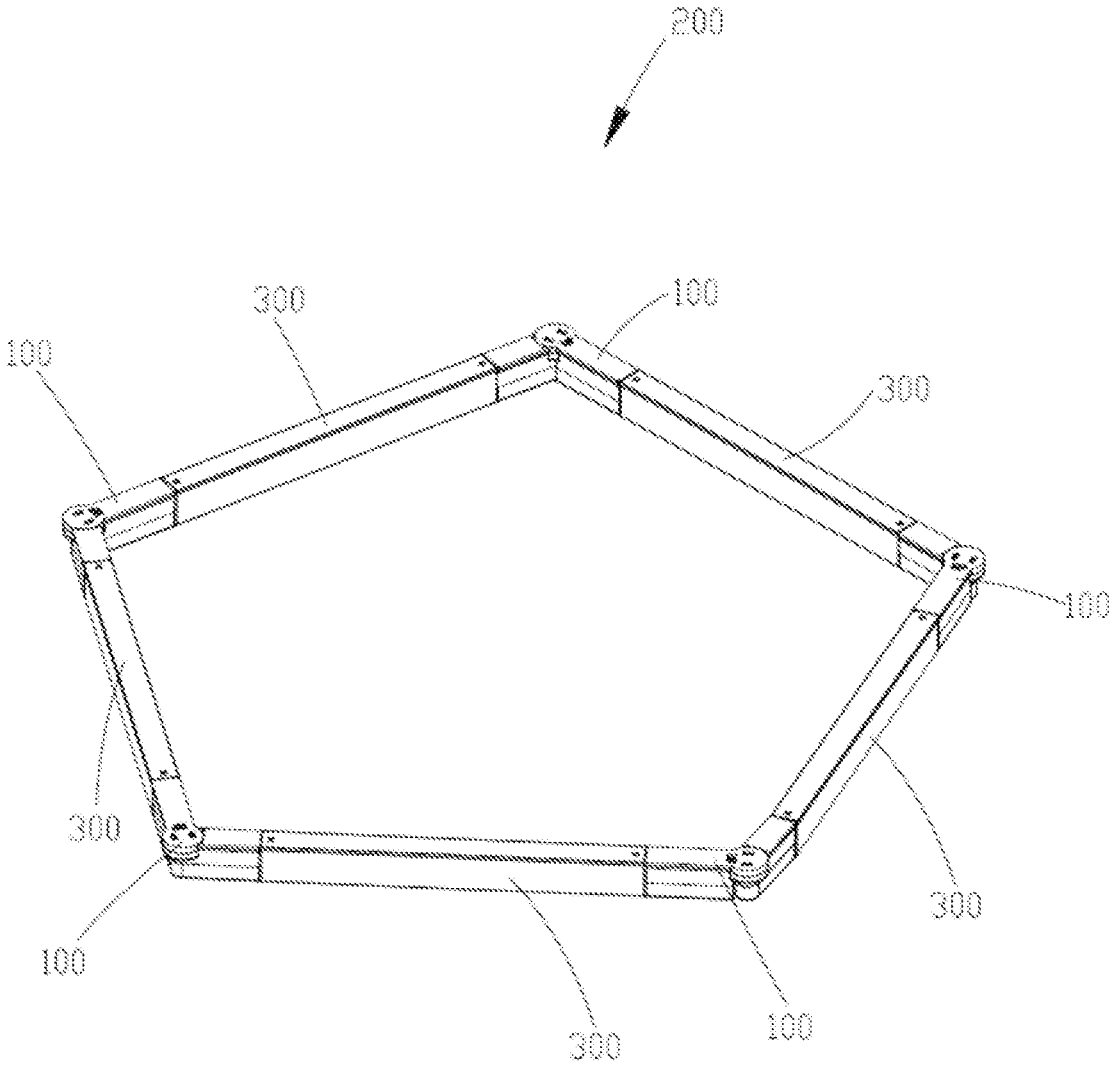
FIG. 13 is a schematic diagram of FIG. 12 from another viewpoint.
Figure 14:
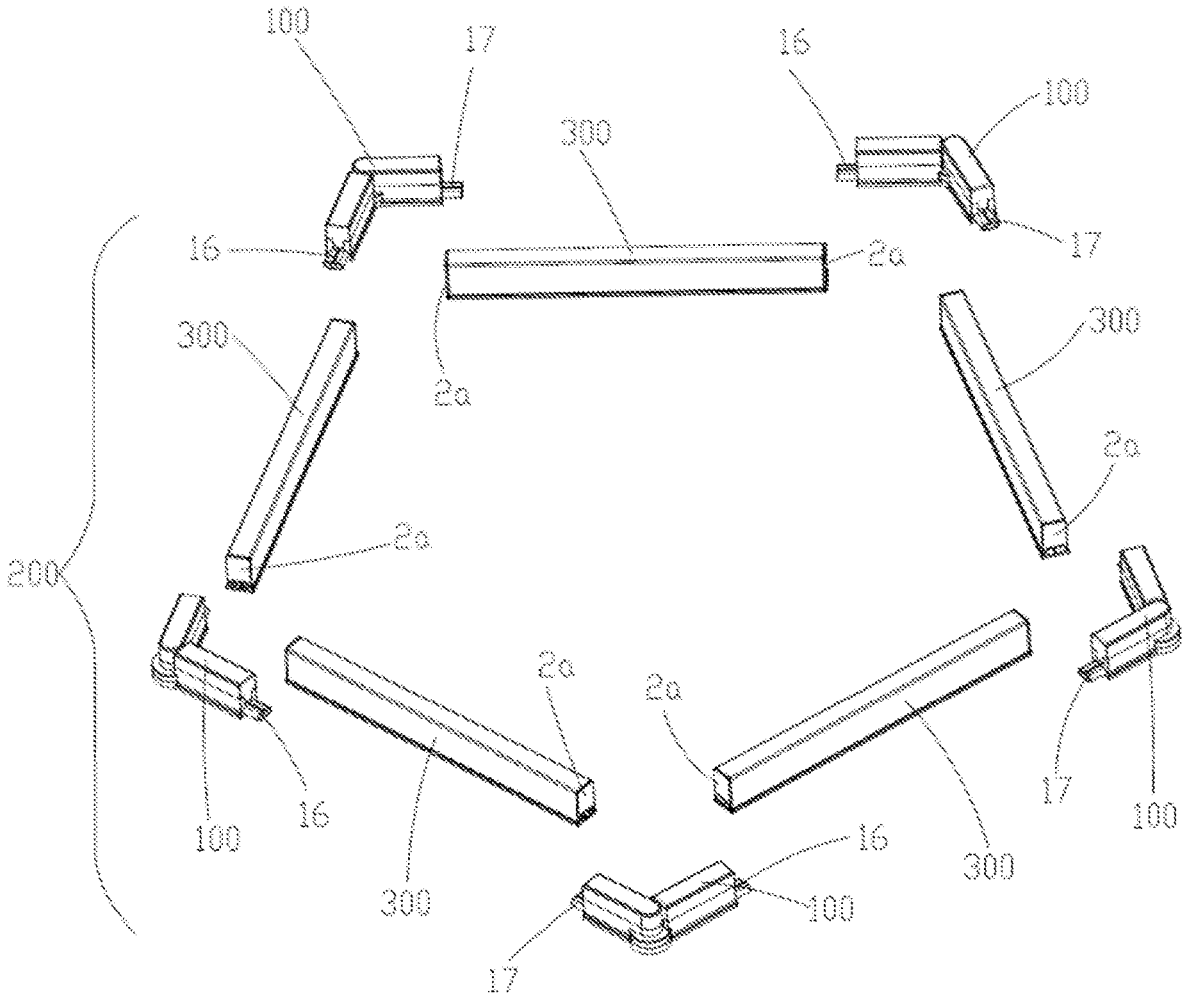
FIG. 14 is an exploded view of FIG. 12.

As shown in FIGS. 12 to 14, the second example of the present disclosure provides an illuminating device 200, which comprises a plurality of linear lamps 300 and a plurality of adapters 100 for connecting any two adjacent linear lamps 300. The plurality of linear lamps 300 are connected by the plurality of adapters 100 to form a closed ring, so as to form the illuminating device 200. In the example, the linear lamp 300 may be an LED T5 tube. Of course, in other examples, the linear lamp 300 may also be a lamp in the linear shape, such as a frame lamp or a wash wall lamp.

Figure 15:
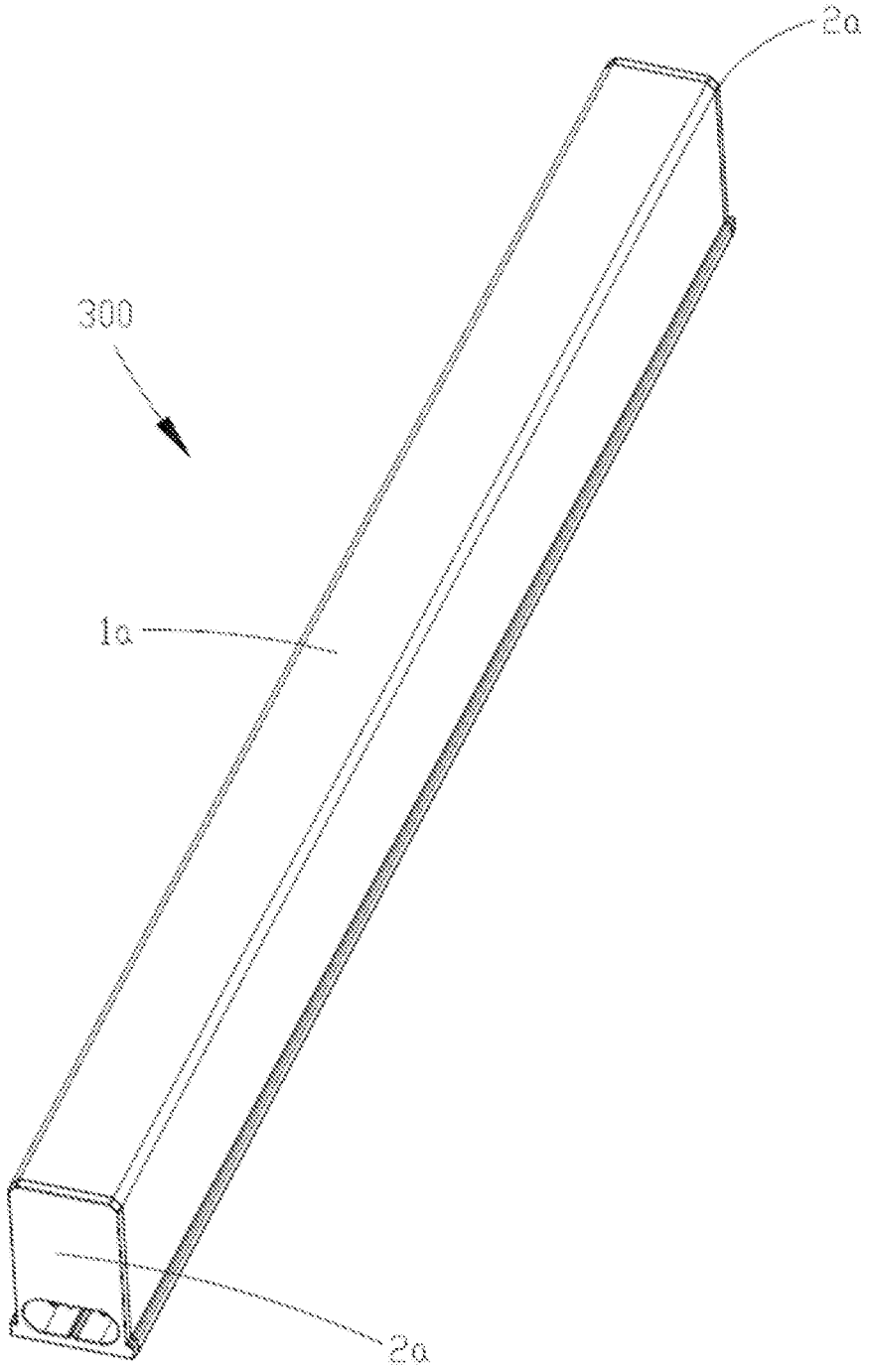
FIG. 15 is a perspective view of a linear lamp in the illuminating device provided by the second example of the present disclosure.
Figure 16:
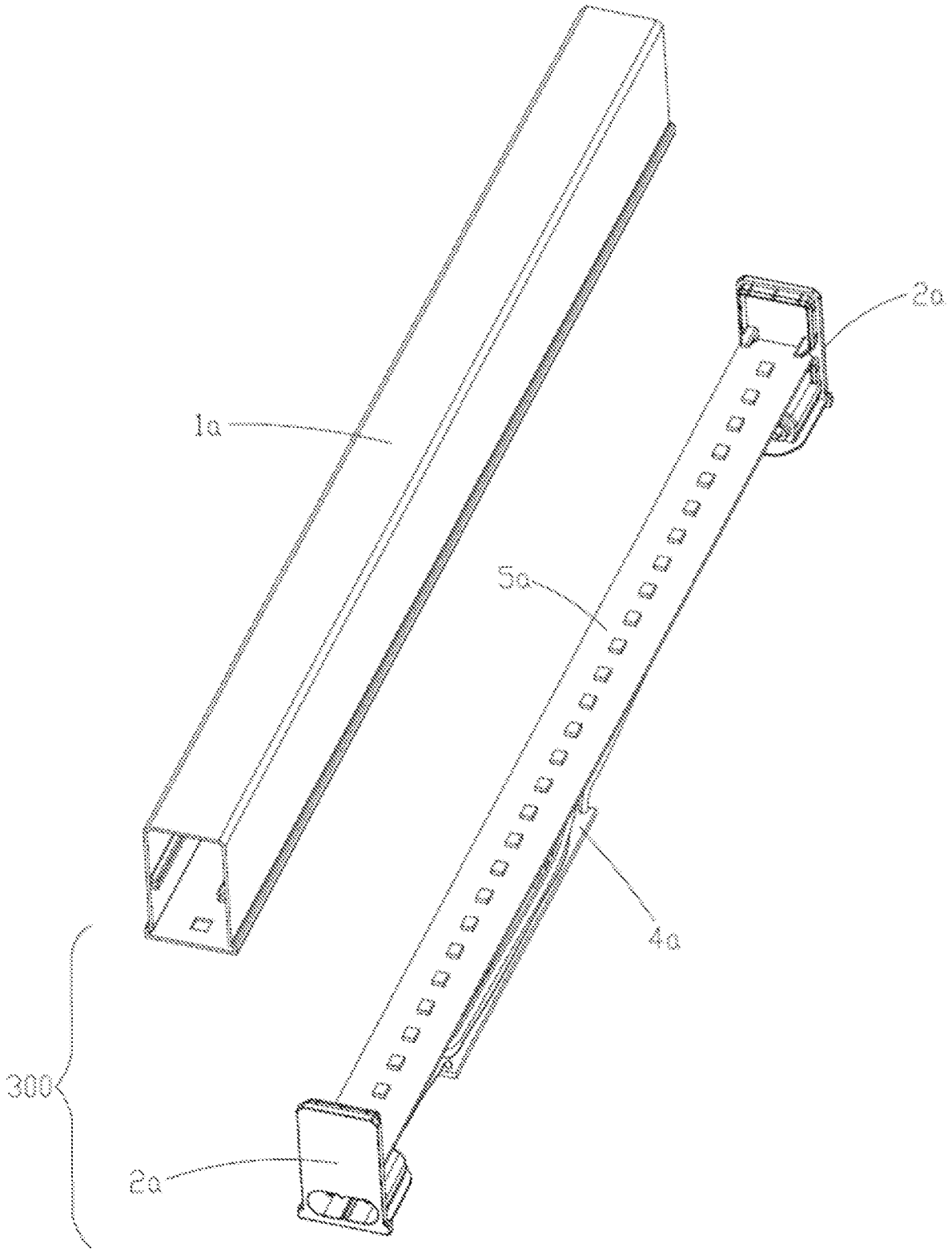
FIG. 16 is a perspective partial exploded view of FIG. 15.
Figure 17:
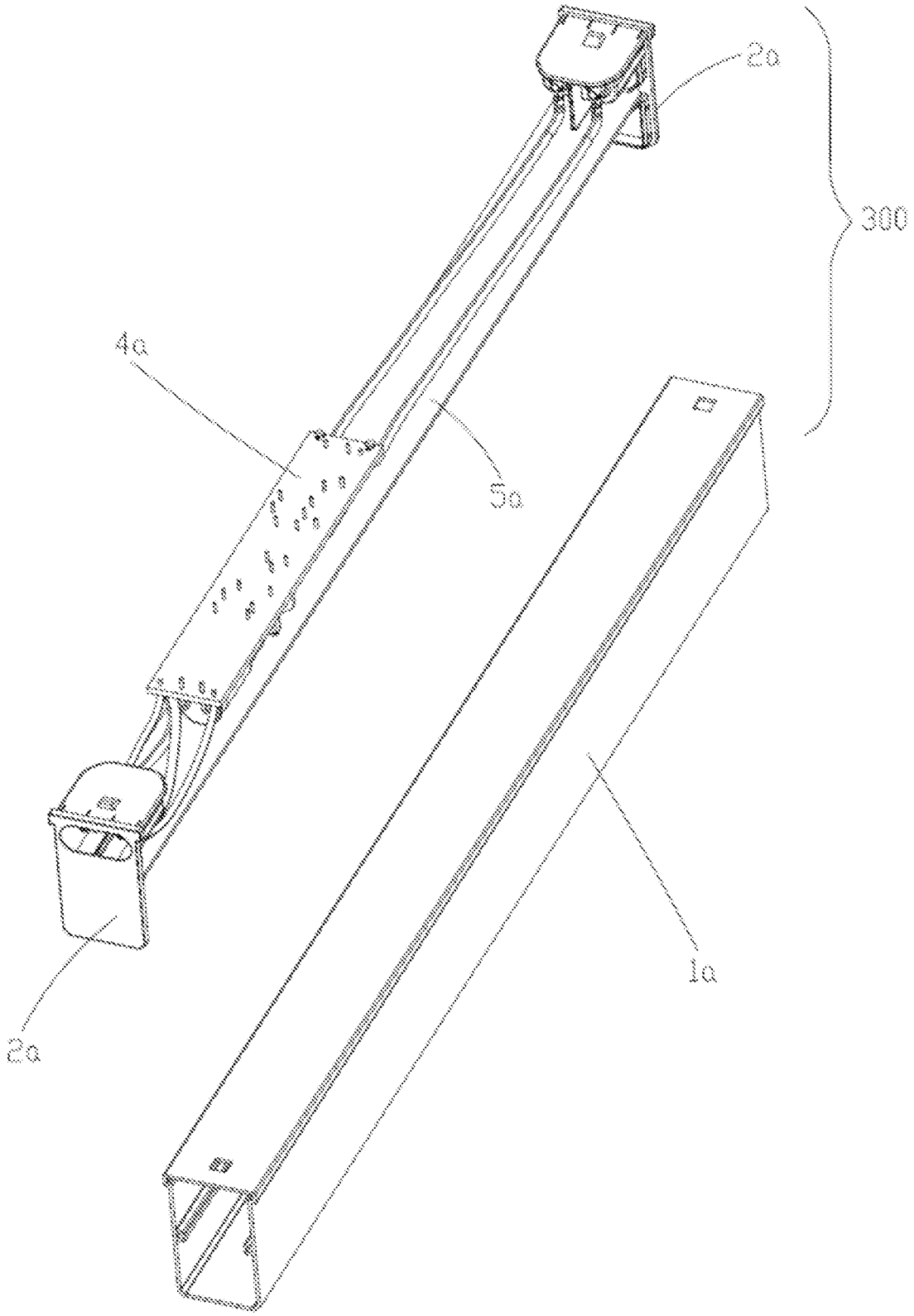
FIG. 17 is a perspective exploded view of FIG. 16 from another viewpoint.

As shown in FIGS. 15 to 17, the linear lamp 300 includes a hollow lamp body 1*a*, a light source component 5*a* and a driving power supply module 4*a* accommodated into the lamp body 1*a* and electrically connected with each other, and two third connectors 2*a* assembled at two ends of the lamp body 1*a*. The two third connectors 2*a* respectively seal the two ends of the lamp body 1*a* and are respectively electrically connected to the driving power supply module 4*a*. Both the third connectors 2*a* are socket connectors.

Specific description will be given below to the structure of the adapter 100 provided by the first example of the present disclosure.

As shown in FIGS. 1 to 11, the adapter 100 provided by the first example of the present disclosure may be applied in the illuminating device 200. Specifically, the adapter 100 comprises a first adapting member 1, a second adapting member 2 electrically connected with the first adapting member 1, and a connecting member 3 for mechanically connecting the first adapting member 1 and the second adapting member 2. The first adapting member 1 and the second adapting member 2 in the adapter 100 may rotate at 0 to 180 degrees.

Specific description will be given below to the structure and the mutual connecting relationships of elements in the first adapting member 1.

As shown in FIGS. 1 to 9, the first adapting member 1 includes: a first base 11, a first pedestal 12 connected with one side of the first base 11, a first light-transmissive hood 13 connected with the other side of the first base 11, a driving power supply module 14 disposed between the first base 11 and the first pedestal 12, a first light source component 15 fixed on the first base 11 and electrically connected with the driving power supply module 14, and a first connector 16 disposed between the first base 11 and the first pedestal 12 and electrically connected with the driving power supply module 14. The first light source component 15 is disposed between the first light-transmissive hood 13 and the first base 11. The first base 11, the first pedestal 12 and the first light-transmissive hood 13 are stacked together in the up and down direction. The first base 11 and the first pedestal 12 may be referred to as a first insulating housing of the first adapting member 1 after connection. The first connector 16 is extended out of one end of the first insulating housing and used for connecting the linear lamps 300 in the illuminating device 200. Of course, in other examples, the first insulating housing is an integral member and provided with an accommodating space therein.

As shown in FIGS. 3-5, 7 and 8, the first base 11 is made from insulating material and is roughly in the shape of a rectangular frame. The first base 11 includes a side wall 111 in a rectangular frame, a first support member 112 extended inwards from an inner surface of the side wall 111, and two opposite first fastening arms 113 extended inwards from the inner surface of the side wall 111. The first support member 112 in the side wall 111 may be used to support the first light source component 15. The two first fastening arms 113 are used to position the first light source component 15 on the first support member 112. A plurality of first through holes 114 are formed on the first support member 112. The side wall 111 is also provided with two positioning blocks (not labeled) connected with the first light-transmissive hood 13. The two positioning blocks may be disposed on left and right sides of the side wall 111.

As shown in FIGS. 5 to 9, the first pedestal 12 is made from insulating material and includes a first main body 121 and a first pivotal part 122 disposed on one side of the first main body 121.

The first main body 121 is provided with an accommodating groove 1211 capable of accommodating the driving power supply module 14, and is also provided with a plurality of first positioning posts 1212 disposed in the accommodating groove 1211. Each of the first positioning posts 1212 includes a first positioning hole 1213, and the first positioning hole 1213 corresponds to the through hole 114 in the first support member 112 of the first base 11.

The first pivotal part 122 includes a base 1221 and a protrusion 1222 extended upwards from the base 1221. Two second through holes 1223 are formed on the base 1221 of the first pivotal part 122, and a wedge-shaped positioning block 1224 is formed on an inner wall of each second through hole 1223. Two third through holes 123 are formed on a junction of the first main body 121 and the first pivotal part 122 of the first pedestal 12, and a projection (not shown) is also formed on an inner wall of each third through hole 123.

As shown in FIGS. 3 to 7, the first adapting member 1 further includes a plurality of positioning members 9 which can run through the first through holes 114 on the first support member 112 of the first base 11 and are accommodated into the first positioning holes 1213 of the first positioning posts 1212 of the first pedestal 12. Sometimes, the positioning members 9 may be screws, and the first positioning holes 1213 are threaded holes. After the first base 11 and the first pedestal 12 are fixedly connected through the positioning members 9, the driving power supply module 14 is disposed in the accommodating space (not labeled) encircled by the assembly of the first base 11 and the first pedestal 12. The first connector 16 is sandwiched between the first base 11 and the first pedestal 12 and extended out of one side of the first insulating housing formed by the first base 11 and the first pedestal 12.

As shown in FIGS. 3 to 8, the first light-transmissive hood 13 is made from insulating material and is light transmissive. The first light-transmissive hood 13 is connected to the first base 11 in a snap fit manner. A first snapping part 131 is respectively disposed at two ends of the first light-transmissive hood 13. Specifically, the first snapping parts 131 may be connected in a snap fit manner with the positioning blocks (not labeled) on the first base 11 to secured/fixedly connect the first light-transmissive hood 13 to the first base 11.

As shown in FIGS. 4 to 8, the driving power supply module 14 is accommodated into the accommodating groove 1211 of the first pedestal 12 and includes a first substrate 141 and one or more components (not labeled) mounted on the substrate 141 and electrically connected with each other through wirings in the substrate 141. The examples of these components include but not limited to an LED drive controller chip, a rectifying chip, a resistor, a capacitor, a fuse, a coil, and the like. The components may be disposed on a side surface or upper and lower side surfaces of the substrate 141. These components may be mounted on the substrate 141 by surface mounting/attachment or in-line packaging/direct inserting.

Figure 1:
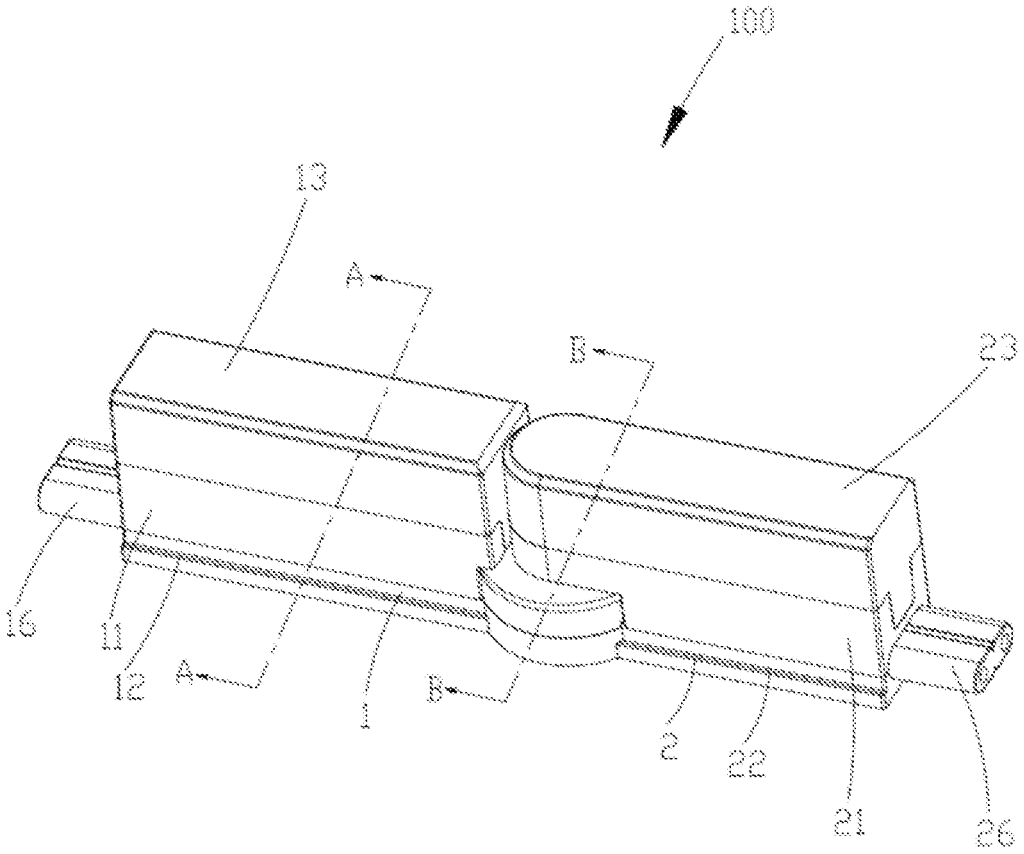
FIG. 1 is a perspective assembly diagram of an adapter provided by the first example of the present disclosure.
Figure 2:
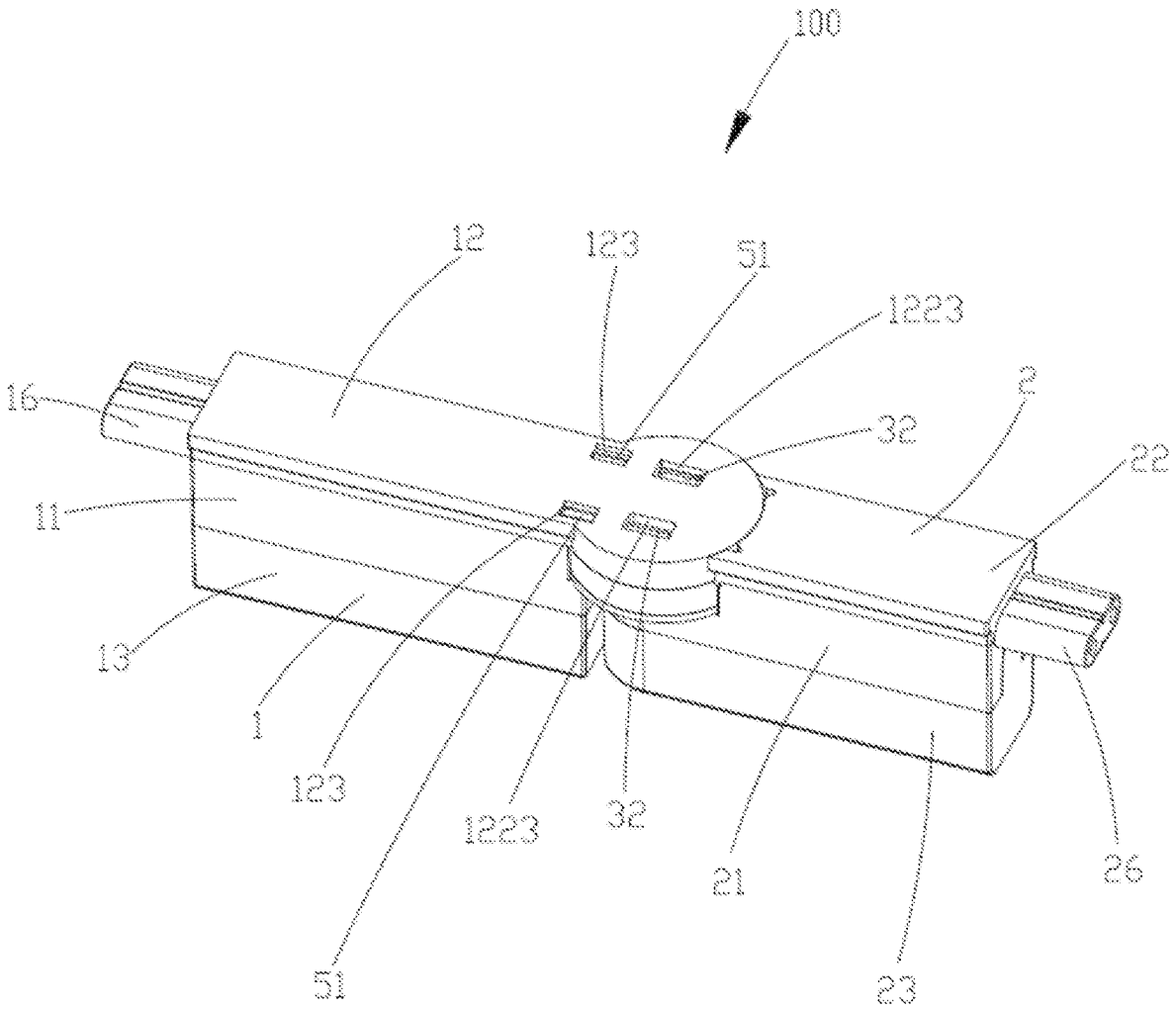
FIG. 2 is a schematic diagram of FIG. 1 from another viewpoint.
Figure 3:
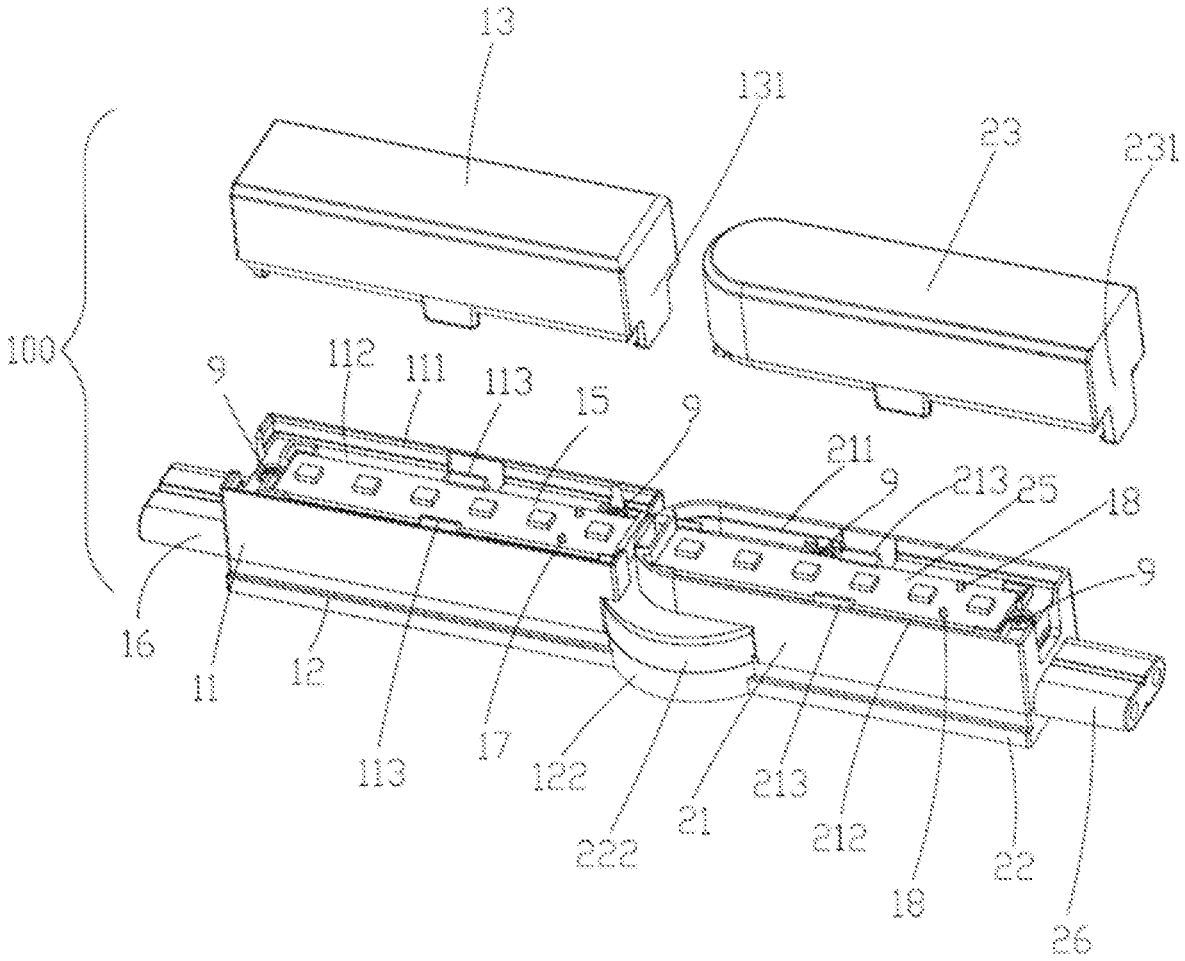
FIG. 3 is a perspective partial assembly diagram of the adapter as shown in FIG. 1.
Figure 4:
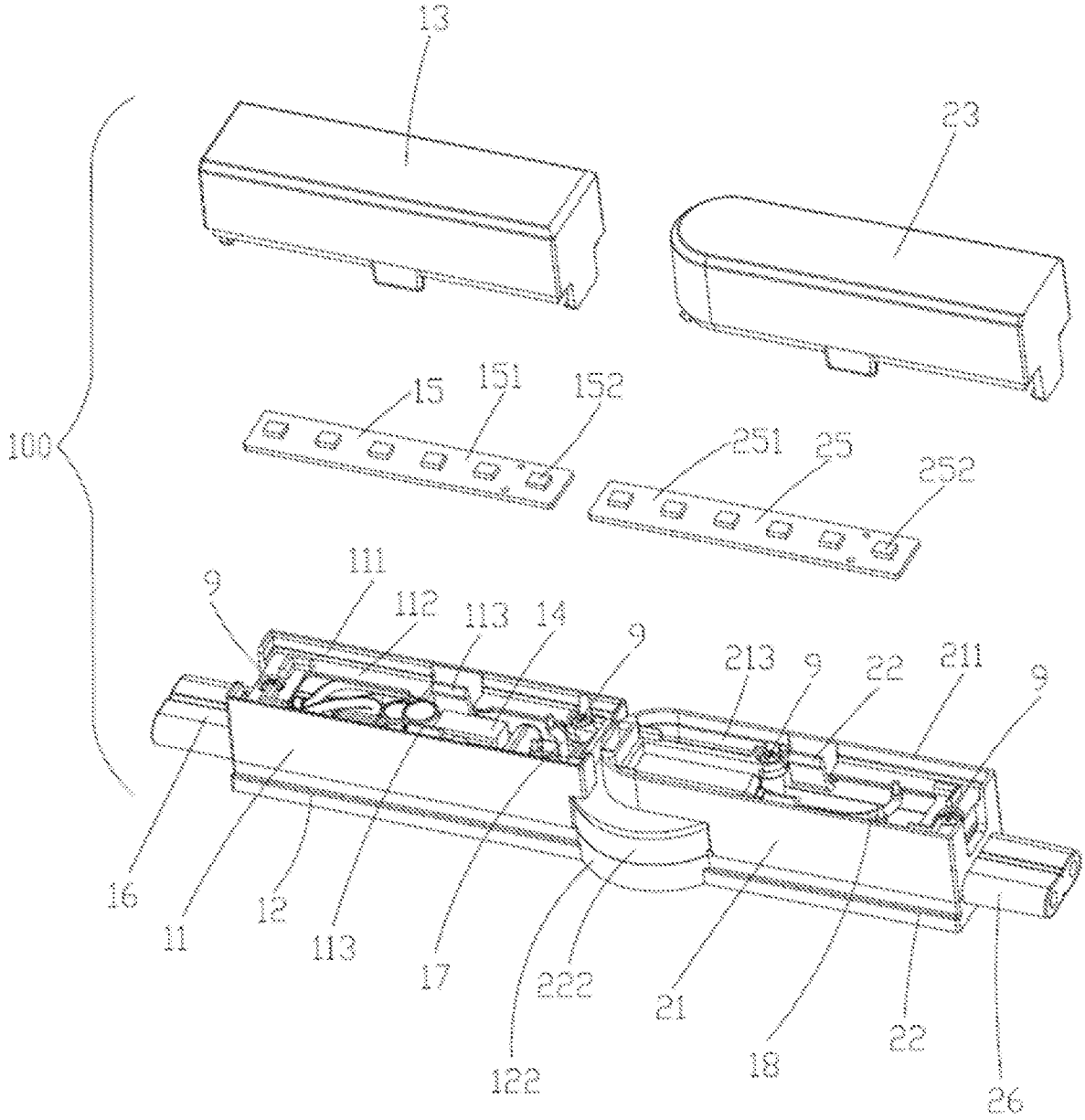
FIG. 4 is another perspective partial assembly diagram of the adapter as shown in FIG. 1.
Figure 5:
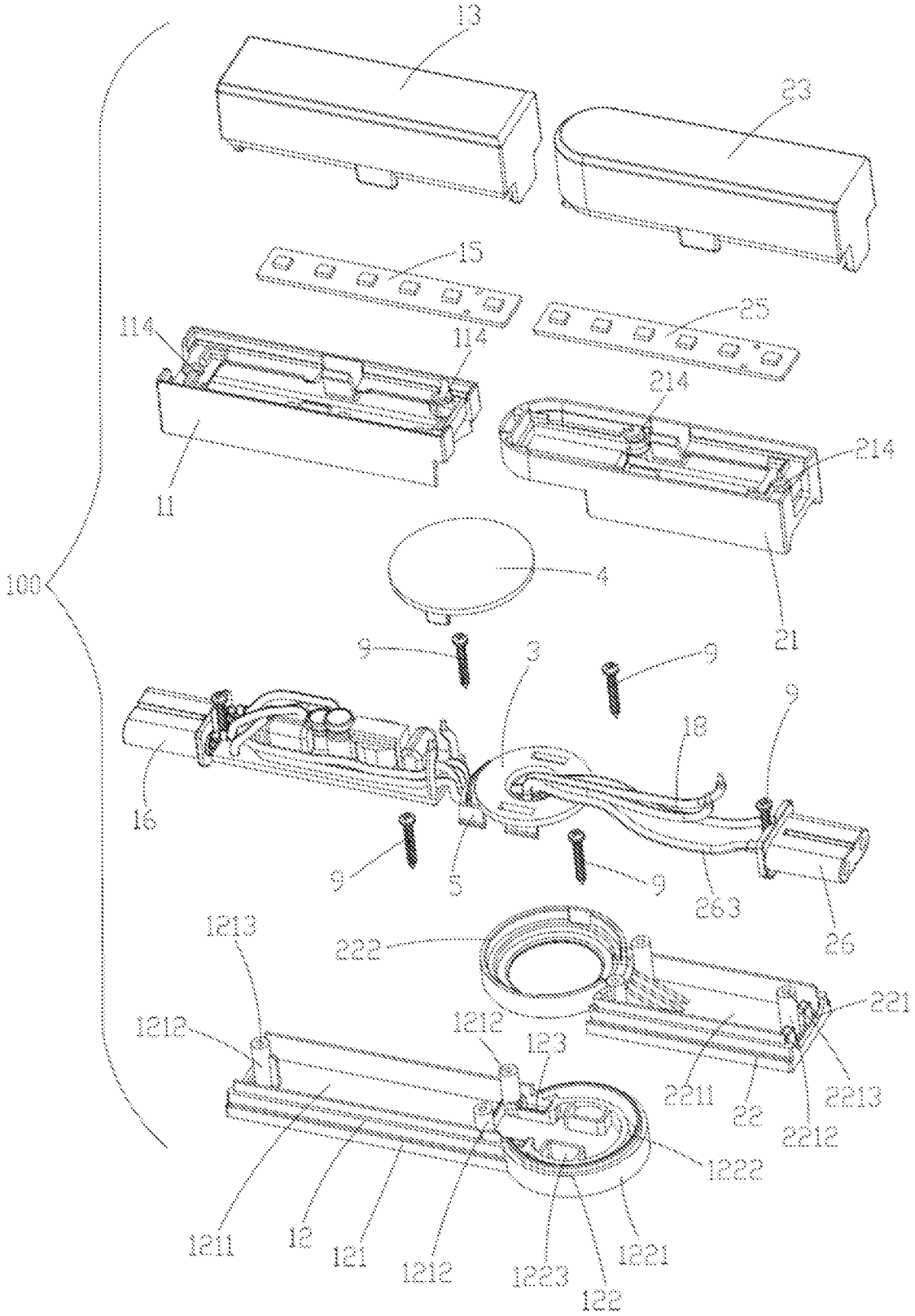
FIG. 5 is an exploded view of the adapter as shown in FIG. 1.
Figure 6:
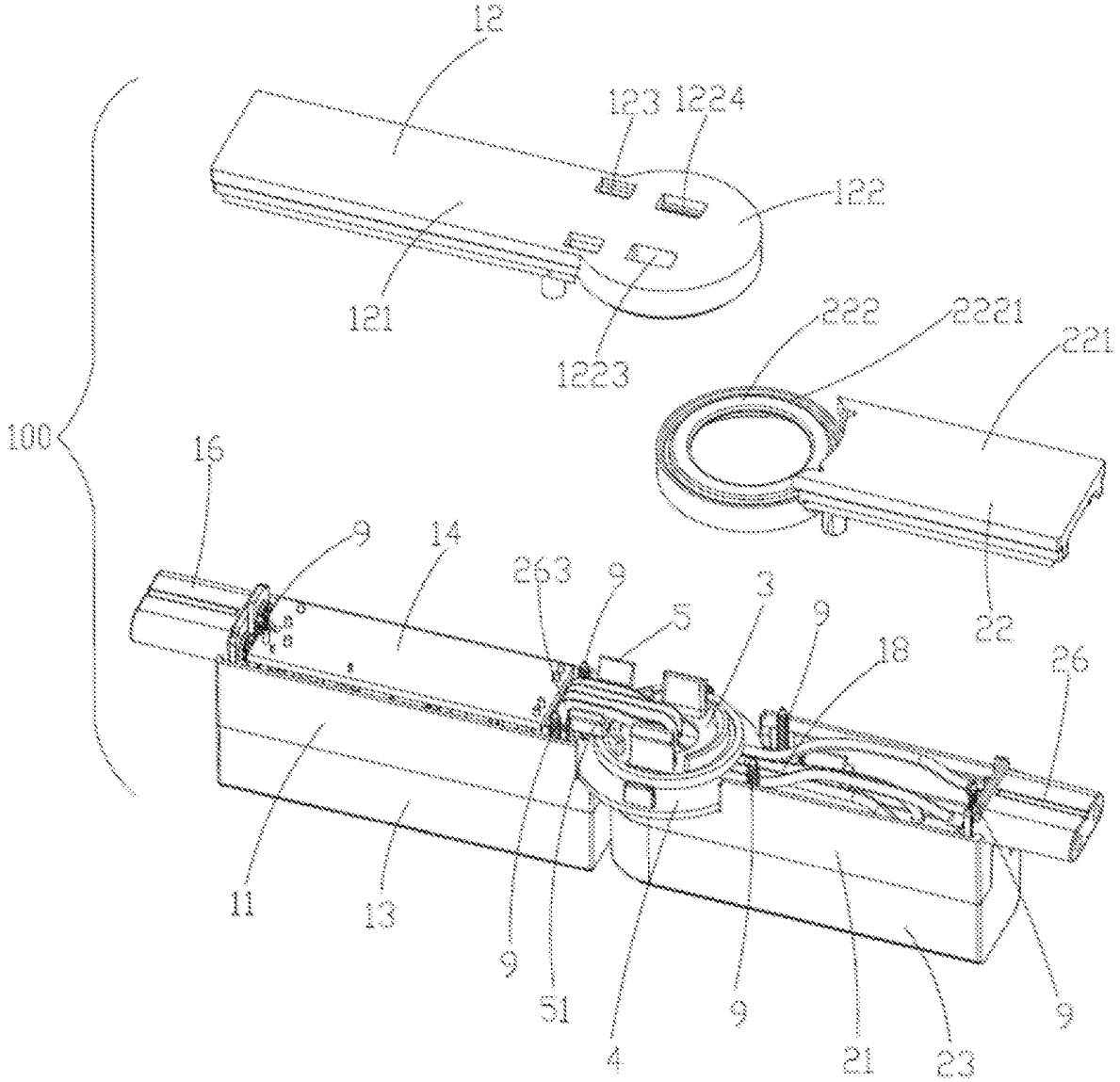
FIG. 6 is a perspective partial assembly diagram of the adapter as shown in FIG. 2.
Figure 7:
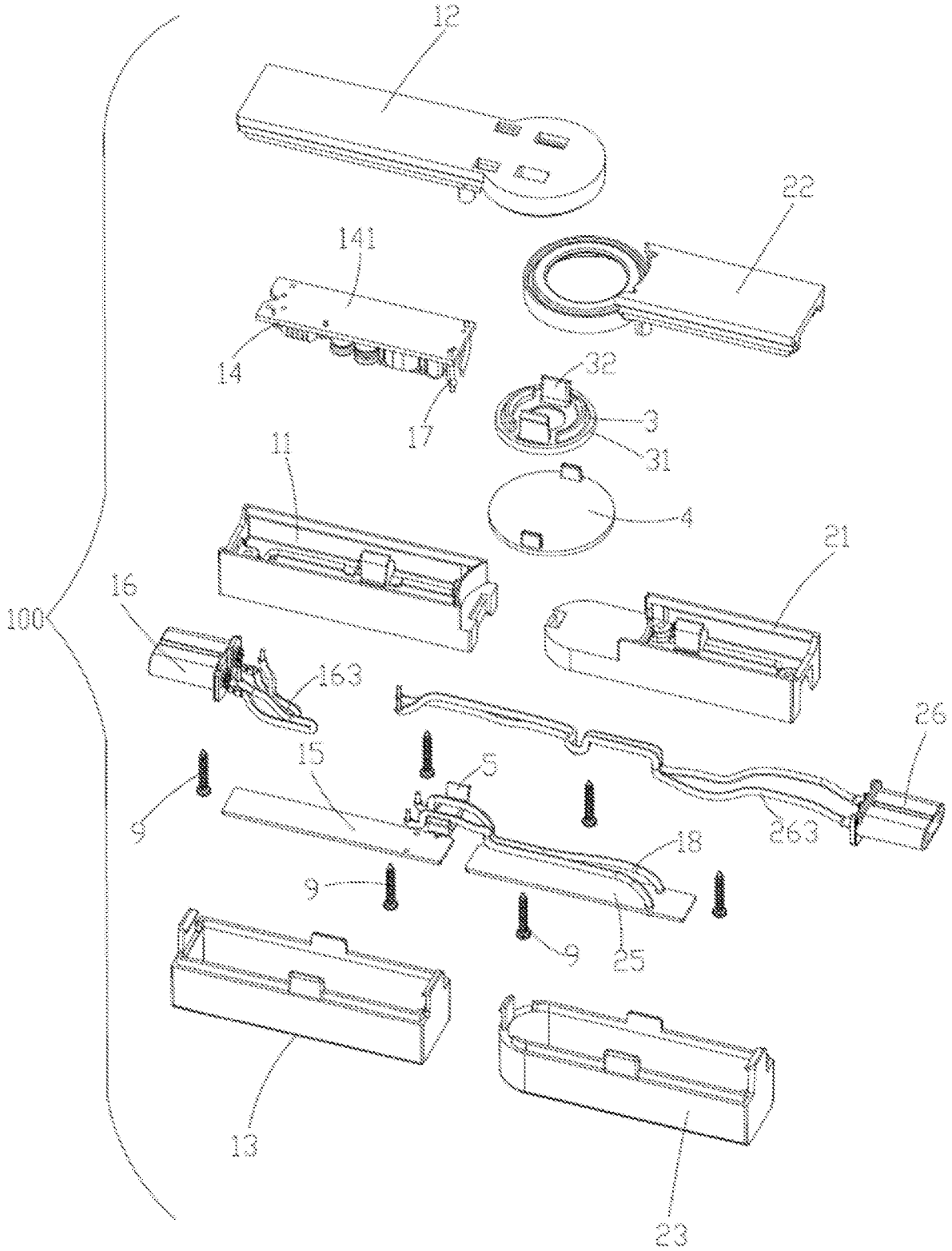
FIG. 7 is an exploded view of the adapter as shown in FIG. 2.
Figure 8:
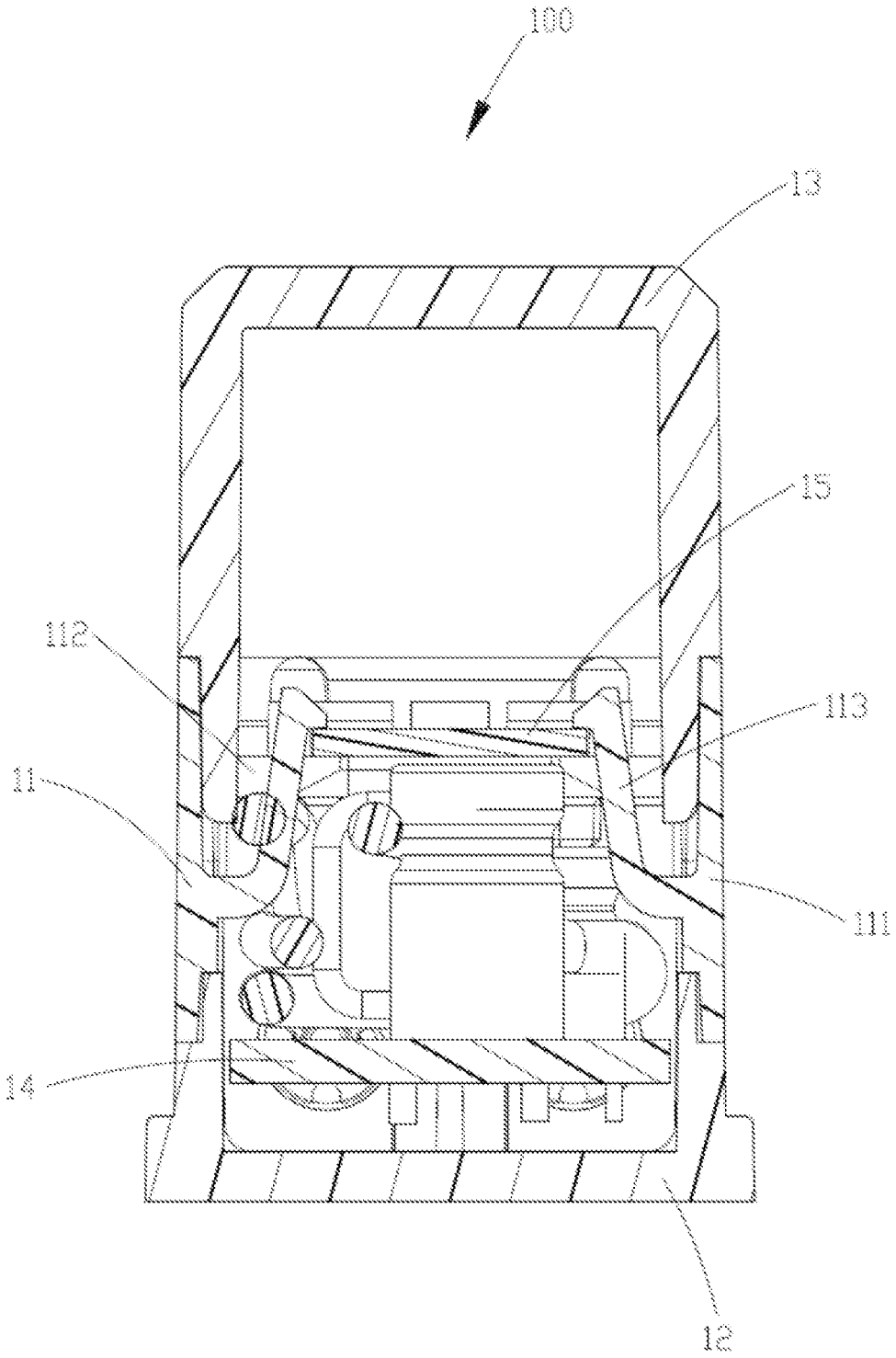
FIG. 8 is a sectional view along the A-A line in FIG. 1.
Figure 9:
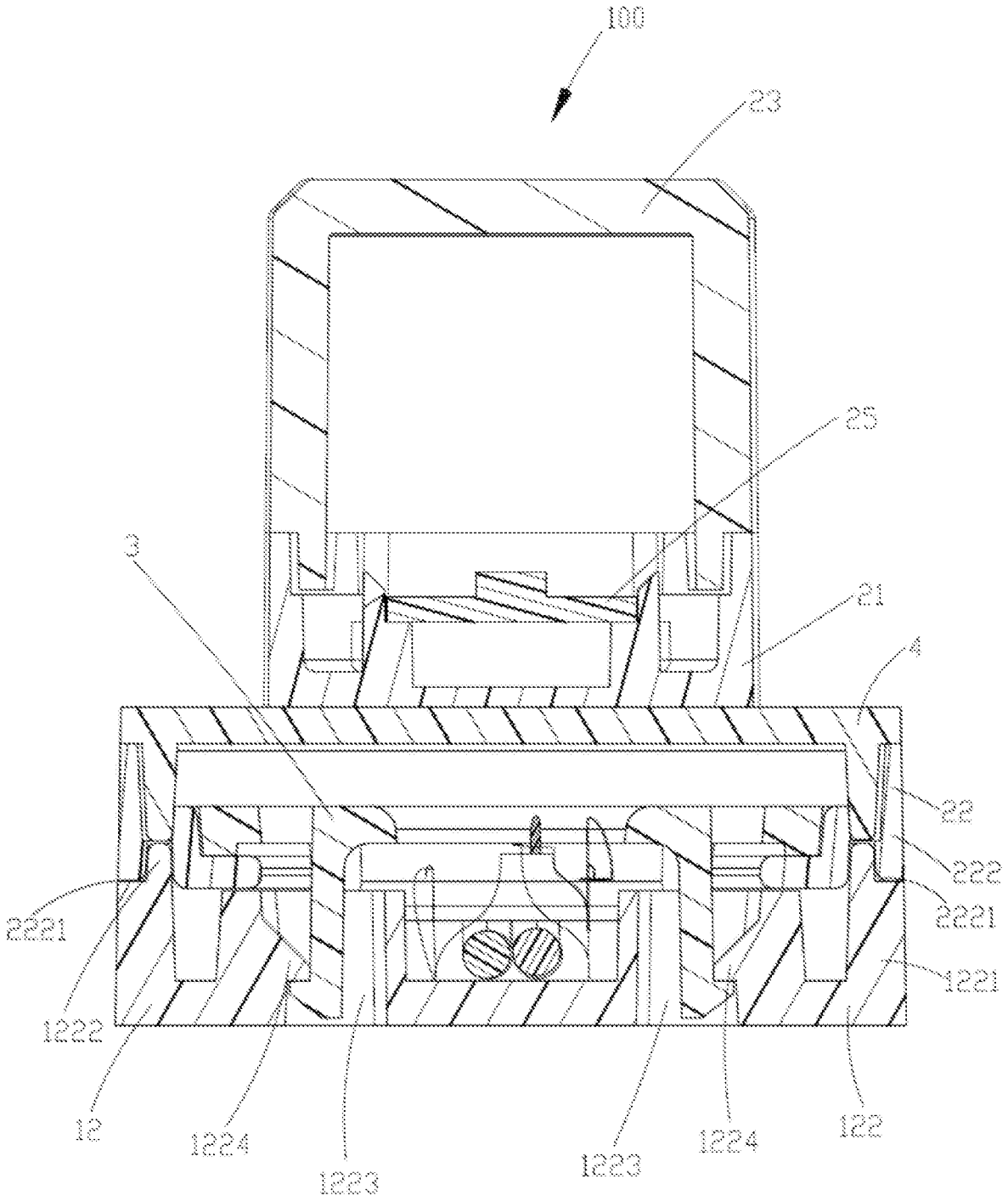
FIG. 9 is a sectional view along the B-B line in FIG. 1.
Figure 10:
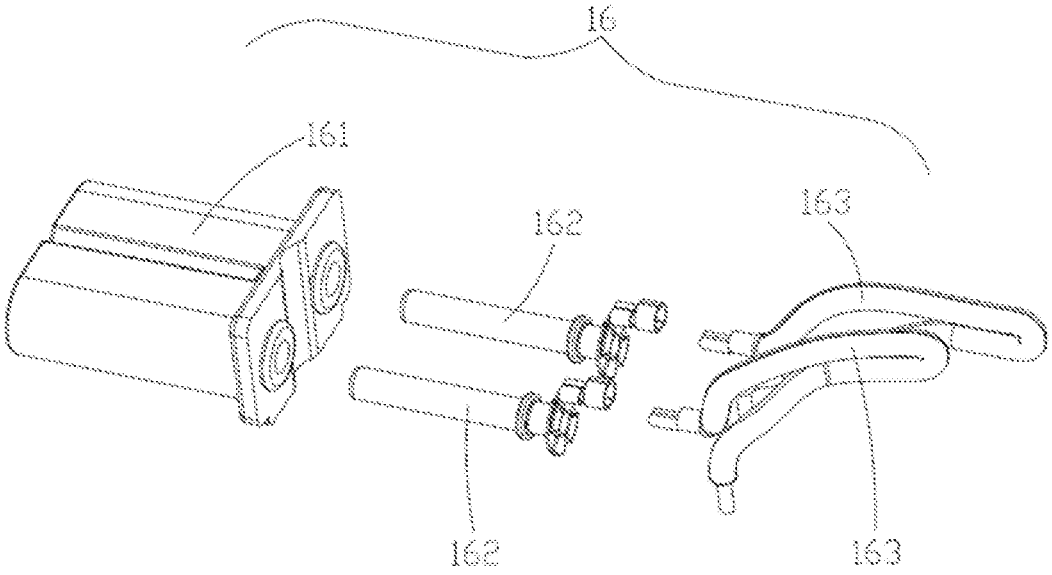
FIG. 10 is an exploded view of a first connector in the adapter as shown in FIG. 1.
Figure 11:
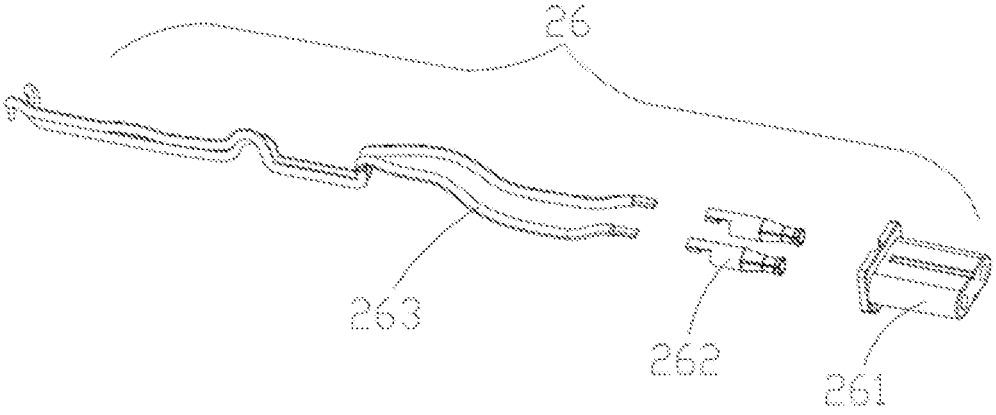
FIG. 11 is an exploded view of a second connector in the adapter as shown in FIG. 1.

As shown in FIGS. 4, 5 and 8, the first light source component 15 is disposed on the first support member 112 of the first base 11. The first light source component 15 is positioned on the first support member 112 through the first fastening arms 113 on the first base 11. The first light source component 15 includes a substrate 151 and a plurality of LED light-emitting units 152 disposed on the substrate 151. The driving power supply module 14 and the first light source component 15 may be electrically connected through wires 17, and the driving power supply module 14 drives the first light source component 15 to emit light.

As shown in FIGS. 5-7 and 10, the first connector 16 is a power input end, and the adapter 100 may receive external power through the first connector 16 and supplies power for the driving power supply module 14. The first connector 16 includes a first insulating body 161, two first conductive terminals 162 accommodated in the first insulating body 161, and a wire 163 respectively electrically connected with the two first conductive terminals 162. The wires 163 on the first connector 16 are electrically connected to the substrate 141 of the driving power supply module 14.

As described above, after the first adapting member 1 receives power through the first connector 16, the first light source component 15 in the first adapter 1 can emit light.

Specific description will be given below to the structure and the mutual connecting relationships of elements in the second adapting member 2.

As shown in FIGS. 1 to 9, the second adapting member 2 includes: a second base 21, a second pedestal 22 connected with the second base 21, a second light-transmissive hood 23 connected with the second base 21, a second light source component 25 fixed on the second base 21 and electrically connected with the driving power supply module 14 in the first adapting member 1, and a second connector 26 disposed between the second base 21 and the second pedestal 22 and electrically connected with the substrate 141 of the driving power supply module 14. The second base 21, the second pedestal 22 and the second light-transmissive hood 23 are stacked together in the up and down direction. The second base 21 and the second pedestal 22 may be referred to as a second insulating housing of the second adapting member 2 after connection. The second connector 26 is extended out of one end of the second insulating housing and used for connecting the linear lamps 300 in the illuminating device 200. The second connector 26 is electrically connected with the first connector 16 through the substrate 141 of the driving power supply module 14, so as to realize the power transmission.

As shown in FIGS. 4-7 and 9, the second base 21 is made from insulating material and is roughly in the shape of a rectangular frame. The second base 21 includes a side wall 211 which is roughly in the shape of a rectangular frame, a second support member 212 extended inwards from an inner surface of the side wall 211, and two opposite second fastening arms 213 extended inwards from the inner surface of the side wall 211. The second support member 212 in the side wall 211 may be used for supporting the second light source component 25. The two second fastening arms 213 are used for positioning the second light source component 25 on the second support member 212. A plurality of fourth through holes 214 are formed on the second support member 212. The side wall 211 is also provided with two positioning blocks (not labeled) used for being connected with the second light-transmissive hood 23. The positioning blocks may be disposed on left and right sides of the side wall 211. One side of the side wall 211 of the second base 21 is in the shape of a circular arc and may contacts the side wall 111 of the first base 11.

As shown in FIGS. 5-7 and 9, the second pedestal 22 is made from insulating material and includes a second main body 221 and a second pivotal part 222 disposed on one side of the second main body 221.

The second main body 221 is provided with an accommodating groove 2211 and is also provided with a plurality of second positioning posts 2212 disposed in the accommodating groove 2211. A second positioning hole 2213 is formed in each second positioning post 2212. The second positioning holes 2213 correspond to the fourth through holes 214 on the second support member 212 of the second base 21.

The second pivotal part 222 is in a shape of a circular ring; an upper surface of the second pivotal part is stepped; and a lower surface of the second pivotal part is provided with a circular ring recess 2221. The protrusion 1222 on the first pivotal part 122 may be rotatably accommodated in the recess 2221 of the second pivotal part 222. In this way, the first pedestal 12 and the second pedestal 22 may realize mutual rotation by the first pivotal part 122 and the second pivotal part 222.

As shown in FIGS. 3-7, the second adapting member 2 further includes a plurality of positioning members 9 which can run through the fourth through holes 214 on the second support member 212 of the second base 21 and are accommodated in the second positioning holes 2213 of the second positioning posts 2212 of the second pedestal 22. Sometimes, the positioning members 9 may be screws. The second base 21 and the second pedestal 22 may be fixedly connected through the positioning members 9. The second connector 26 is sandwiched between the second base 21 and the second pedestal 22 and extended out of one end of the second insulating housing formed by the second base 21 and the second pedestal 22.

As shown in FIGS. 1-9, the second light-transmissive hood 23 is made from insulating material and is light transmissive. The second light-transmissive hood 23 is connected to the second base 21 in a snap fit manner. A second snapping part 231 is respectively disposed at two ends of the second light-transmissive hood 23. Specifically, the second snapping part 231 may be fastened with the positioning blocks (not labeled) on the second base 21 to fixedly connect the second light-transmissive hood 23 to the second base 21.

As shown in FIGS. 3-5 and 9, the second light source component 25 is disposed on the second support member 212 of the second base 21. The second light source component 25 is positioned on the second support member 212 through the second fastening arms 213 on the second base 21. The second light source component 25 includes a substrate 251 and a plurality of LED light-emitting units 252 disposed on the substrate 251. The driving power supply module 14 and the second light source component 25 may be electrically connected through wires 18, and the driving power supply module 14 drives the second light source component 25 to emit light.

As shown in FIGS. 3-6 and 11, the second connector 26 is a power output end, and the adapter 100 may supply the received external power to the linear lamp(s) 300 of the illuminating device 200 through the second connector 26. The second connector 26 includes a second insulating body 261, two second conductive terminals 262 accommodated in the second insulating body 261, and wires 263 respectively electrically connected with the two second conductive terminals 262. The wires 263 on the second connector 26 are electrically connected to the substrate 141 of the driving power supply module 14.

As described above, after the second adapting member 2 receives power through the first connector 16, the driving power supply module 14 may drive the second light source component 25 in the second adapting member 2 to emit light.

As shown in FIGS. 5-7 and 9, the connecting member 3 for connecting the first pedestal 12 of the first adapting member 1 and the second pedestal 22 of the second adapting member 2 is integrally formed by insulating material, and includes a flat plate 31 and two clamping arms 32 extended downwards from a lower surface of the flat plate 31. The clamping arms 32 run through the second pivotal part 222 and the second through holes 1223 on the first pivotal part 122 and are connected with the positioning blocks 1224 in the second through holes 1223 in a snap fit manner. The flat plate 31 abuts against an upper surface of the second pivotal part 222. By adoption of the connecting member 3, the first pivotal part 122 and the second pivotal part 222 are connected with each other without affecting the pivoting motion between the first pivotal part and the second pivotal part. In this way, the first adapting member 1 and the second adapting member 2 can realize mutual rotation. As the first adapting member 1 and the second adapting member 2 can realize mutual rotation, the adapter 100 can adjust the angle between the first adapting member 1 and the second adapting member 2 according to the configuration requirement of the illuminating device 200.

Moreover, as shown in FIGS. 5-7 and 9, the adapter 100 further comprises a cover plate 4 assembled on the connecting member 3. The cover plate 4 is circular and contacts side surfaces of both the first base 11 and the second base 21. The cover plate 4 is assembled on the upper surface of the second pivotal part 222 of the second pedestal 22. The wires 18 run through the second pivotal part 222 of the second pedestal 22 and are electrically connected with the second light source component 25. The wires 263 of the second connector 26 also run through the second pivotal part 222 and are electrically connected with the substrate 141 of the driving power supply module 14.

As shown in FIGS. 2 and 5-7, the adapter 100 further comprises a wire clamp 5. The wire clamp 5 is roughly U-shaped and includes two fastening arms 51. The two fastening arms 51 are extended into the two third through holes 123 on the first pedestal 12 and fastened with the projections on the inner wall of the third through holes 123 in a snap fit manner. In this way, the wires 18 and 263 in the adapter 100 can be arranged in order and limited therein.

The adapter 100 provided by the first example of the present disclosure may be applied in the illuminating device 200 provided by the second example of the present disclosure. Two ends of the adapter may be respectively connected with a linear lamp 300. The adapter 100 comprises a driving power supply module 14, a first light source component 15 and a second light source component 25 electrically connected with the driving power supply module 14, and a first connector 16 and a second connector 26 connected with the driving power supply module 14. As the adapter 100 comprises the driving power supply module 14 and the first and second light source components 15 and 25, after the adapter 100 is powered on through the first connector 6, both the first and second light source components 15 and 25 in the adapter 100 can emit light. As the adapter 100 can independently emit light, the example overcomes the defect in the certain illuminating device that dark areas are produced at junctions of adjacent linear lamps due to the arrangement of the adapter, so the illuminating device 200 can maintain the illumination continuity while enlarging the lighting area. Meanwhile, as the rotation angle between the first adapting member 1 and the second adapting member 2 in the adapter 100 can be randomly adjusted between 0 and 180 degrees, the illuminating device 200 may be a closed configuration.

The present disclosure also discloses an illuminating device, which overcomes the defect in certain illuminating device that dark areas are produced at junctions of adjacent linear lamps due to the arrangement of adapters, because the adapters can independently emit light.

The present disclosure further discloses a method of manufacturing an adapter for the adapting of at least two linear lamps in an illuminating device. The method may include obtaining a first adapting member where the first adapting member includes a first insulating housing, a first light-transmissive hood assembled on the first insulating housing, a first light source component disposed between the first insulating housing and the first light-transmissive hood, and a first connector extended out of the first insulating housing; obtaining a second adapting member where the second adapting member includes a second insulating housing, a second light-transmissive hood assembled on the second insulating housing, a second light source component disposed between the second insulating housing and the second light-transmissive hood, and a second connector extended out of the second insulating housing; and obtaining a driving power supply module that is capable of being disposed in the first or second adapting member and is electrically connected with the first and second light source components.

The objective of the present disclosure is to solve the technical problem and provide an adapter applied to an illuminating device, which can realize the continuous linear lighting effect of the illuminating device without dark areas.

In order to achieve the this objective, the present disclosure provides an adapter, which is used for the adapting of at least two linear lamps in an illuminating device and comprises: a first adapting member including a first insulating housing, a first light-transmissive hood assembled on the first insulating housing, a first light source component disposed between the first insulating housing and the first light-transmissive hood, and a first connector extended out of the first insulating housing; a second adapting member including a second insulating housing, a second light-transmissive hood assembled on the second insulating housing, a second light source component disposed between the second insulating housing and the second light-transmissive hood, and a second connector extended out of the second insulating housing; and a driving power supply module capable of being disposed in the first or second adapting member and electrically connected with the first and second light source components.

Furthermore, the first adapting member and the second adapting member are pivotally connected.

Furthermore, the adapter further comprises a connecting member which connects the first adapting member and the second adapting member.

Furthermore, the driving power supply module is integrated with the first or second light source component to form an optoelectronic integrated component.

Furthermore, the first insulating housing includes a first base and a first pedestal fixedly connected with the first base; the driving power supply module is disposed between the first base and the first pedestal; the first light-transmissive hood is connected with the first base; and the first light source component is disposed between the first base and the first light-transmissive hood.

Furthermore, the first base is provided with a first support member for supporting the first light source component and first fastening arms for positioning the first light source component on the first support member.

Furthermore, the first adapting member further includes a plurality of positioning members for connecting the first base and the first pedestal.

Furthermore, the first light-transmissive hood and the first base are detachably connected; and the first light-transmissive hood is provided with first snapping parts for providing a snap fit connection with the first base.

Furthermore, the second insulating housing includes a second base and a second pedestal fixedly connected with the second base; the second light-transmissive hood is connected with the second base; and the second light source component is disposed between the second base and the second light-transmissive hood.

Furthermore, the second base is provided with a second support member for supporting the second light source component and second fastening arms for positioning the second light source component on the second support member.

Furthermore, the second adapting member further includes a plurality of positioning members for connecting the second base and the second pedestal.

Furthermore, a first pivotal part is disposed at one end of the first insulating housing; a second pivotal part mated with the first pivotal part is disposed at one end of the second insulating housing; the first pivotal part and the second pivotal part may rotate mutually; and the connecting member connects the first pivotal part and the second pivotal part.

Furthermore, the connecting member includes a flat plate and clamping arms extended out of the flat plate; the flat plate abuts against an upper surface of the second pivotal part; and the clamping arms run through the second pivotal part and are connected with the first pivotal part in a snap fit manner.

Furthermore, the first pivotal part is provided with a protrusion; the second pivotal part is provided with a recess; and the protrusion is rotatably accommodated into the recess.

The objective of the present disclosure is to solve the problem and provide an illuminating device capable of realizing wide-area continuous illumination.

In order to achieve the above objective, the present disclosure provides an illuminating device, which comprises: a plurality of linear lamps and the adapters as described in the above summary of the present disclosure. The plurality of linear lamps are connected by the adapters.

Compared with the other implementations, the adapter provided by the example of the present disclosure may be applied in the illuminating device. Two ends of the adapter may be respectively connected with a linear lamp. The adapter comprises a driving power supply module, a first light source component and a second light source component electrically connected with the driving power supply module, and a first connector and a second connector connected with the driving power supply module. As the adapter comprises the driving power supply module and the first and second light source components, after the adapter is powered on through the first connector, the driving power supply module can drive both the first and second light source components in the adapter to emit light. As the adapter can independently emit light, it overcomes the defect in the certain illuminating device that dark areas are produced at junctions of adjacent linear lamps due to the arrangement of the adapter, so the illuminating device can maintain the illumination continuity while enlarging the lighting area.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module may be a hardware component or an element with or without an electronic circuit The foregoing examples are provided for further demonstrating the objective, the technical proposals and the advantages of the present disclosure. It should be understood that the foregoing is only the examples of the present disclosure and not intended to limit the present disclosure. Any modification, equivalent replacement, improvement or the like within the spirit and the principle of the present disclosure shall fall within the scope of protection of the present disclosure.

What is claimed is:

1. An adapter for the adapting of at least two linear lamps in an illuminating device, comprising:

a first adapting member comprising a first insulating housing, a first light-transmissive hood assembled on the first insulating housing, a first light source component disposed between the first insulating housing and the first light-transmissive hood, and a first connector extended out of the first insulating housing;

a second adapting member comprising a second insulating housing, a second light-transmissive hood assembled on the second insulating housing, a second light source component disposed between the second insulating housing and the second light-transmissive hood, and a second connector extended out of the second insulating housing; and a driving power supply module capable of being disposed in the first or second adapting member and electrically connected with the first and second light source components, wherein the first connector is a power input end that receives external power, the second connector is a power output end that supplies the received external power to a linear lamp, the first connector and the second connector are symmetrically located on two opposing ends of the adapter and the adapter is bendable using a pivotal part between the first connector and the second connector, and the linear lamp is structured differently from the adapter.

2. The adapter according to claim 1, wherein the first adapting member and the second adapting member are pivotally connected.

3. The adapter according to claim 2, wherein the adapter further comprises a connecting member which connects the first adapting member and the second adapting member.

4. The adapter according to claim 1, wherein the driving power supply module is integrated with the first or second light source component to form an integrated module.

5. The adapter according to claim 1, wherein the first insulating housing comprises a first base and a first pedestal fixedly connected with the first base; the driving power supply module is disposed between the first base and the first pedestal; the first light-transmissive hood is connected with the first base; and the first light source component is disposed between the first base and the first light-transmissive hood.

6. The adapter according to claim 5, wherein the first base is provided with a first support member for supporting the first light source component and first fastening arms for positioning the first light source component on the first support member.

7. The adapter according to claim 6, wherein the first adapting member further comprises a plurality of positioning members for connecting the first base and the first pedestal.

8. The adapter according to claim 7, wherein the first light-transmissive hood and the first base are detachably connected; and the first light-transmissive hood is provided with first snapping parts for providing a snap fit connection with the first base.

9. The adapter according to claim 5, wherein the second insulating housing comprises a second base and a second pedestal fixedly connected with the second base; the second light-transmissive hood is connected with the second base; and the second light source component is disposed between the second base and the second light-transmissive hood.

10. The adapter according to claim 9, wherein the second base is provided with a second support member for supporting the second light source component and second fastening arms for positioning the second light source component on the second support member.

11. The adapter according to claim 10, wherein the second adapting member further comprises a plurality of positioning members for connecting the second base and the second pedestal.

12. The adapter according to claim 3, wherein a first pivotal part is disposed at one end of the first insulating housing; a second pivotal part mated with the first pivotal part is disposed at one end of the second insulating housing; the first pivotal part and the second pivotal part may rotate mutually; and the connecting member connects the first pivotal part and the second pivotal part.

13. The adapter according to claim 12, wherein the connecting member comprises a flat plate and clamping arms extended out of the flat plate; the flat plate abuts against an upper surface of the second pivotal part; and the clamping arms run through the second pivotal part and are connected with the first pivotal part in a snap fit manner.

14. The adapter according to claim 13, wherein the first pivotal part is provided with a protrusion; the second pivotal part is provided with a recess; and the protrusion is rotatably accommodated into the recess.

15. An illuminating device, comprising: a plurality of linear lamps and an adapter for the adapting of the plurality of linear lamps in the illuminating device, wherein the plurality of linear lamps are connected by the adapter, and the adapter comprises: a first adapting member comprising a first insulating housing, a first light-transmissive hood assembled on the first insulating housing, a first light source component disposed between the first insulating housing and the first light-transmissive hood, and a first connector extended out of the first insulating housing; a second adapting member comprising a second insulating housing, a second light-transmissive hood assembled on the second insulating housing, a second light source component disposed between the second insulating housing and the second light-transmissive hood, and a second connector extended out of the second insulating housing; and a driving power supply module capable of being disposed in the first or second adapting member and electrically connected with the first and second light source components, wherein the first connector is a power input end that receives external power, the second connector is a power output end that supplies the received external power to a linear lamp, the first connector and the second connector are symmetrically located on two opposing ends of the adapter and the adapter is bendable using a pivotal part between the first connector and the second connector, and the linear lamp is structured differently from the adapter.

16. The illuminating device according to claim 15, wherein the first adapting member and the second adapting member are pivotally connected.

17. The illuminating device according to claim 16, wherein the adapter further comprises a connecting member which connects the first adapting member and the second adapting member.

18. A method of manufacturing an adapter for the adapting of at least two linear lamps in an illuminating device, comprising:

obtaining a first adapting member wherein the first adapting member comprises a first insulating housing, a first light-transmissive hood assembled on the first insulating housing, a first light source component disposed between the first insulating housing and the first light-transmissive hood, and a first connector extended out of the first insulating housing;

obtaining a second adapting member wherein the second adapting member comprises a second insulating housing, a second light-transmissive hood assembled on the second insulating housing, a second light source component disposed between the second insulating housing and the second light-transmissive hood, and a second connector extended out of the second insulating housing; and obtaining a driving power supply module that is capable of being disposed in the first or second adapting member and is electrically connected with the first and second light source components, wherein the first connector is a power input end that receives external power, the second connector is a power output end that supplies the received external power to a linear lamp, the first connector and the second connector are symmetrically located on two opposing ends of the adapter and the adapter is bendable using a pivotal part between the first connector and the second connector, and the linear lamp is structured differently from the adapter.

19. The method according to claim 18, wherein the first adapting member and the second adapting member are pivotally connected.

20. The method according to claim 19, further comprising obtaining a connecting member which connects the first adapting member and the second adapting member.

* * * * *